US005351712A

United States Patent [19]

Houlihan

[11] Patent Number: 5,351,712

[45] Date of Patent: Oct. 4, 1994

[54] HOT WATER RECOVERY SYSTEM

[76] Inventor: John A. Houlihan, 1210-A E. Foster Rd., Santa Maria, Calif. 93455

[21] Appl. No.: 157,668

[22] Filed: Nov. 23, 1993

[51] Int. Cl.[5] ..... F16K 49/00

[52] U.S. Cl. ..... 137/337; 137/565; 137/389; 137/624.12; 417/12; 417/32

[58] Field of Search ..... 4/191, 192; 137/337, 137/565, 389, 390, 624.12, 563; 126/362; 417/32, 12; 236/12.12

[56] References Cited

U.S. PATENT DOCUMENTS

| | | | |
|---|---|---|---|
| 3,705,574 | 12/1972 | Duncan | 126/362 |
| 3,799,181 | 3/1974 | Maddren | 137/1 |
| 4,142,515 | 3/1979 | Skatts | 126/362 |
| 4,160,461 | 7/1979 | Vataru | 137/337 |
| 4,166,944 | 9/1979 | Scott | 219/330 |
| 4,201,518 | 5/1980 | Stevenson | 417/12 |
| 4,321,943 | 3/1982 | Haws | 137/337 |
| 4,450,829 | 5/1984 | Morita | 126/362 |
| 4,606,325 | 8/1986 | Lujan | 126/362 |
| 4,628,902 | 12/1986 | Comber | 126/362 |
| 4,672,990 | 6/1987 | Robillard | 137/59 |
| 4,682,581 | 7/1987 | Laing | 126/362 |
| 4,697,614 | 10/1987 | Powers et al. | 137/337 |
| 4,756,030 | 7/1988 | Juliver | 137/334 |
| 4,774,978 | 10/1988 | Lepine, Jr. et al. | 137/334 |
| 4,870,986 | 10/1989 | Barrett et al. | 137/119 |
| 4,917,142 | 4/1990 | Laing et al. | 137/337 |
| 4,930,551 | 6/1990 | Haws | 137/337 |
| 4,936,289 | 6/1990 | Peterson | 126/362 |
| 4,945,942 | 8/1990 | Lund | 137/624.12 |
| 5,009,572 | 4/1991 | Imhoff | 417/32 |
| 5,042,524 | 8/1991 | Lund | 137/337 |
| 5,050,062 | 9/1991 | Hass | 137/624.12 |
| 5,105,846 | 4/1992 | Britt | 137/337 |
| 5,205,318 | 4/1993 | Massaro et al. | 137/337 |
| 5,261,443 | 11/1993 | Walsh | 137/337 |

*Primary Examiner*—A. Michael Chambers

[57] ABSTRACT

An on demand, remotely activated, electronically and electro-mechanically controlled, energy saving, water conservation, hot, water recovery system, which may be installed in residential and commercial structures having a pressurized water supply (11). The system is comprised of a dual chamber, dual hot water outlet, water heating reservoir (23), and a flow control and recovery apparatus (10), in fluid communication with a cold water supply (11) and hot water outlets (93–97). The system installs in new or existing structures, without alteration of the plumbing lines or electrical wiring. The flow control (84) is preprogrammed to, upon command, drain standing water from the hot water outlets (93–97), and refill the outlets with hot water from the small chamber (**23*b*) of the water heating reservoir (23), making hot water available at the instant an outlet is opened. During hot water use, the system delivers hot water to the hot water outlets (93–97) from the large chamber (23*a*), of the water heating reservoir (23). Discontinuance of hot water use, for a time, causes the flow control (84) to configure the recovery apparatus (10) to return hot water in the hot water outlets, before it cools, to the small chamber (23*b*). The recovery apparatus (10**) refills the empty hot water outlets with cold water, then resets to the ready condition. The system may be configured for use with any conventional water heater.

10 Claims, 4 Drawing Sheets

HOT WATER RECOVERY SYSTEM

BACKGROUND

1. Field of the Invention

This invention is in the field of hot water delivery and recovery systems, specifically, to an efficient energy saving, water conserving, hot water recovery system.

Description of the Problem Area

In a conventional plumbing system including a water heating system and hot and cold water faucets, it is a well known fact, that, water is retained in the hot water line between the water heating system and the hot water faucet and that with time, this water cools down. As a result, when one wants hot water, the usual procedure is to turn on the hot water faucet and to wait while the water retained in the hot water line between the water heating system and the faucet is drained. This is inconvenient and wastes both water and energy. In order to solve the problems of inconvenience and water waste, hot water recirculating systems are typically installed.

A preponderance of hot water recirculation systems require additional plumbing to complete a loop from the furthest hot water outlet, returning to the water heater. In existing structures, installing unexposed replumbing lines becomes prohibitively expensive, messy and time consuming, and for most home owners, requires the hiring of one or more building trades professionals. In such systems, thermostatic sensors react to water cooling in the lines, triggering frequent pump operation. Return pipe loops contribute to the loss of additional heat, because of the increased volume of water cooling and the increased cooling surface of the added lengths of pipe; even insulated pipes relinquish their heat. Public Utilities rate existing recirculating pump systems as net energy consumers. The problem is best solved by a system that functions with either a modified or a conventional water heater, is in operation only when hot water is needed, doesn't allow water to be wasted down the drain waiting for the hot water to arrive at the use point and eliminates the energy loss which results when hot water is permitted to cool in the plumbing lines.

2.Brief Description of Prior Art

Vataru, et al U.S. Pat. No. 4,160,461 Jul. 10, 1979

Vataru shows a water saving system. This system fails to address the problem of lost energy due to hot water cooling in the plumbing lines between hot water usage cycles.

Lujan U.S. Pat. No. 4,606,325 Aug. 19, 1986

Lujan, shows a hot water recirculation system. In existing structures this system requires the installation of a return line to recirculate cooled hot water to the water heater. The installation, if the plumbing is to remain unexposed, requires that openings must be made in walls, ceilings and/or floors and then repaired. This is time consuming and expensive; for most home owners, it would require the employment of one or more building trade professionals.

Powers & Powers U.S. Pat. No. 4,697,614 Oct. 6, 1987

Powers shows a water conservation system. This system requires an installation below each sink taking up most of the storage space beneath the sink. Where pedestal sinks are installed the unit would be exposed. It does not address the problem of energy loss due to hot water cooling in the lines.

Barrett, et al U.S. Pat. No. 4,870,986 Oct. 3, 1989

Barrett shows a system for dispensing liquid at a desired temperature. This system is primarily one for moderating temperature and controlling flow at system outlets. In existing structures this system requires the installation of a return line to recirculate cooled hot water to the water heater.

Laing, et al U.S. Pat. No. 4,917,142 Apr. 17, 1990

Laing shows a hot water recirculation system. In existing structures this system requires the retrofitting of the existing plumbing system with additional piping to form a hot water return loop to the hot water reservoir. The installation, if the plumbing is to remain unexposed, requires that openings must be made in walls and on some cases ceilings or floors, which must then be repaired; it is messy, time consuming and expensive, and for most home owners, usually requires the employment of one or more building trade professionals.

Haws - U.S. Pat. No. 4,930,551 Jun. 5, 1990

Haws shows a hot water recovery system with a water heater apparatus having a closed cylindrical cylinder within the heater tank. With this approach, when the hot water faucet is opened, the hot water supply line must still be purged of the cold water which backflowed into the hot water supply line. This device does not reduce the amount of cold water that, must be purged (i.e. wasted) from the hot water supply line before usable hot water can be drawn from the faucet.

The return of hot water in the lines to the hot water heater is not rapid permitting loss of heat energy during the process and the system cannot be utilized effectively with a conventional water heater.

Peterson U.S. Pat. No. 4,930,551 Jun. 26, 1990

Peterson shows a system for controlling the recirculation of a hot water distribution system. In existing structures this system requires the installation of a return line to recirculate cooled hot water to the water heater. The installation, if the plumbing is to remain unexposed, requires that openings must be made in walls, ceilings and/or floors and then repaired. This is time consuming and expensive; for most home owners, it would require the employment of one or more building trade professionals.

Imhoff U.S. Pat. No. 5,009,572 Apr. 23, 1991

Imhoff shows a water conservation system installed inside a standard bathroom vanity. This system requires a pump unit at the hot water outlets and the need for an electrical outlet in close proximity to the unit. It takes up space beneath the sink. Where pedestal sinks are installed the unit would be exposed. It is unclear as to how effectively pump pressure would overcome system supply pressure.

Lund U.S. Pat. No. 5,042,524 Aug. 27, 1991

Lund shows a demand recovery hot water system. This system does not address the problem of lost energy due to hot water cooling in the plumbing lines, between hot water usage cycles.

In existing structures this system requires the retrofitting of the existing plumbing system with additional piping to form a hot water return loop to the hot water reservoir. The installation, if the plumbing is to remain unexposed, requires that openings must be made in walls and in some cases ceilings or floors, which must then be repaired; it is messy, time consuming and expensive and for most home owners, it usually requires the employment of one or more building trade professionals.

Britt U.S. Pat. No. 5,105,846 Apr. 21, 1992

Britt shows a water saving system. This system is designed to prevent water waste but it does not address the problem of lost energy due to hot water cooling the plumbing lines, between hot water usage cycles.

Massaro, et al U.S. Pat. No. 5,205,318, Apr. 27, 1993

Massaro shows a water saving system. This system requires installation of a manifold unit beneath the sink using up storage area and requires the close proximity of an electrical outlet. Where pedestal sinks are installed the unit would be exposed. Once usage is completed the problem still exists of heated water cooling in the lines.

Objects and Advantages

Accordingly, one object of the invention is to provide an improved, energy saving hot water system.

Another object is to provide a system which delivers hot water on demand without having to waste water down the drain, waiting for hot water to arrive at the hot water outlet.

Another object is to provide a system that recovers hot water from the hot water outlet lines rapidly, minimizing the heat loss of water cooling in the plumbing lines.

Another object is to provide a system which utilizes only the original plumbing lines in an existing structure, eliminating the need for expensive retrofitting of an existing structure with added hot water return pipes.

Another object of the invention is to provide an energy and water savings system that, may be quickly and easily installed in new or existing structure, by the average home owner.

Another advantage is that the system can be utilized as a portable self-contained apparatus enabling property lessees, as well as property owners, to be able to reduce energy and water consumption.

These and other objects and advantages of the present invention will become apparent from a consideration of the following detailed description and the accompanying drawings.

SUMMARY

According to the present invention there is provided a water and energy conservation system which solves the problem of water waste and energy loss, in a manner unknown heretofore.

In all embodiments, the system avoids water being wasted down the drain while waiting for the hot water to arrive at the hot water outlet. It prevents large amounts of energy loss after hot water usage ceases, by rapidly returning the hot water standing in the outlet lines to the water heating reservoir, before any appreciable heat loss can occur.

A remote controlled on demand hot water delivery and recovery system in accordance with the present. Invention, in fluid communication with a pressurized cold water supply conduit and hot water supply conduit of a water heating reservoir and coupled to one or more hot water outlets. In its preferred embodiment, it is comprised of a dual chamber, dual hot water outlet, water heating reservoir, a power source, a flow control and recovery apparatus, and a remote control device.

The hot water recovery system conveniently installs in an existing residential or commercial structure, without requiring additional plumbing lines or electrical wiring. Installation is complete in a matter of hours, no special tools are required, and plumbing or electrical experience is not necessary. The only structural addition is a small vent relief flow device, in the input line of the hot water outlets.

When the immediate replacement of an existing water heater, with a dual chamber, dual hot water outlet, water heating reservoir, is not warranted, the flow control and recovery apparatus may be conveniently configured for use separately, with virtually any water heater, at no additional expense to the user. During periods of power interruption, the system functions as any normal hot water distribution system.

LIST OF REFERENCE NUMERALS

Figure 1:
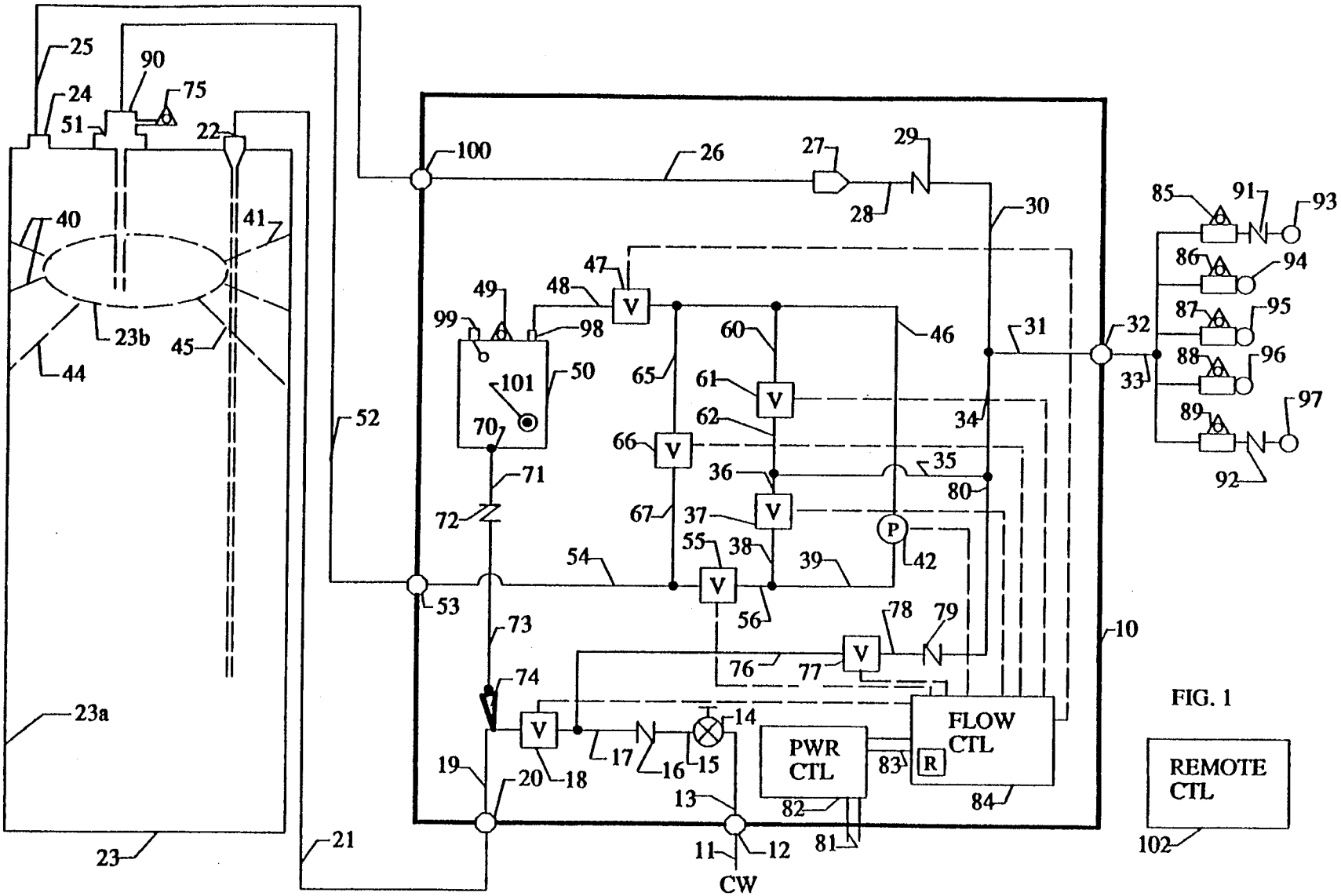
FIG. 1 is a flow diagram of a hot water distribution system embodying the present invention.

| FIG. 1 | |
|---|---|
| 10. | Flow control and recovery apparatus |
| 11. | Cold Water Supply - pressurized |
| 12. | Cold Water Supply Inlet |
| 13. | Conduit |
| 14. | System manual shut off Valve |
| 15. | Conduit |
| 16. | Check Valve |
| 17. | Conduit |
| 18. | Remotely Actuated Valve |
| 19. | Conduit |
| 20. | Cold Water Supply Outlet |
| 21. | Conduit |
| 22. | Inlet to large chamber 23a |
| 23. | Dual Chamber, Dual Hot Water Outlet Water Heating Reservoir |
| 23a. | Large Chamber |
| 23b. | Small Chamber |
| 24. | Hot Water Outlet, Large Chamber |
| 25. | Conduit |
| 26. | Conduit |
| 27. | Flow Switch |
| 28. | Conduit |
| 29. | Check Valve |
| 30. | Conduit |
| 31. | Conduit |
| 32. | Dual Purpose Inlet/Outlet |
| 33. | Conduit |
| 34. | Conduit |
| 35. | Conduit |
| 36. | Conduit |
| 37. | Remotely Actuated Valve |
| 38. | Conduit |
| 39. | Conduit |
| 40. | Upper Brace Set Left |
| 41. | Upper Braoe Set Right |
| 42. | Pump with Motor |
| 43. | Unused |
| 44. | Lower Brace Left |
| 45. | Lower Brace Right |
| 46. | Conduit |
| 47. | Remotely Actuated Valve |

-continued

Figure 2:
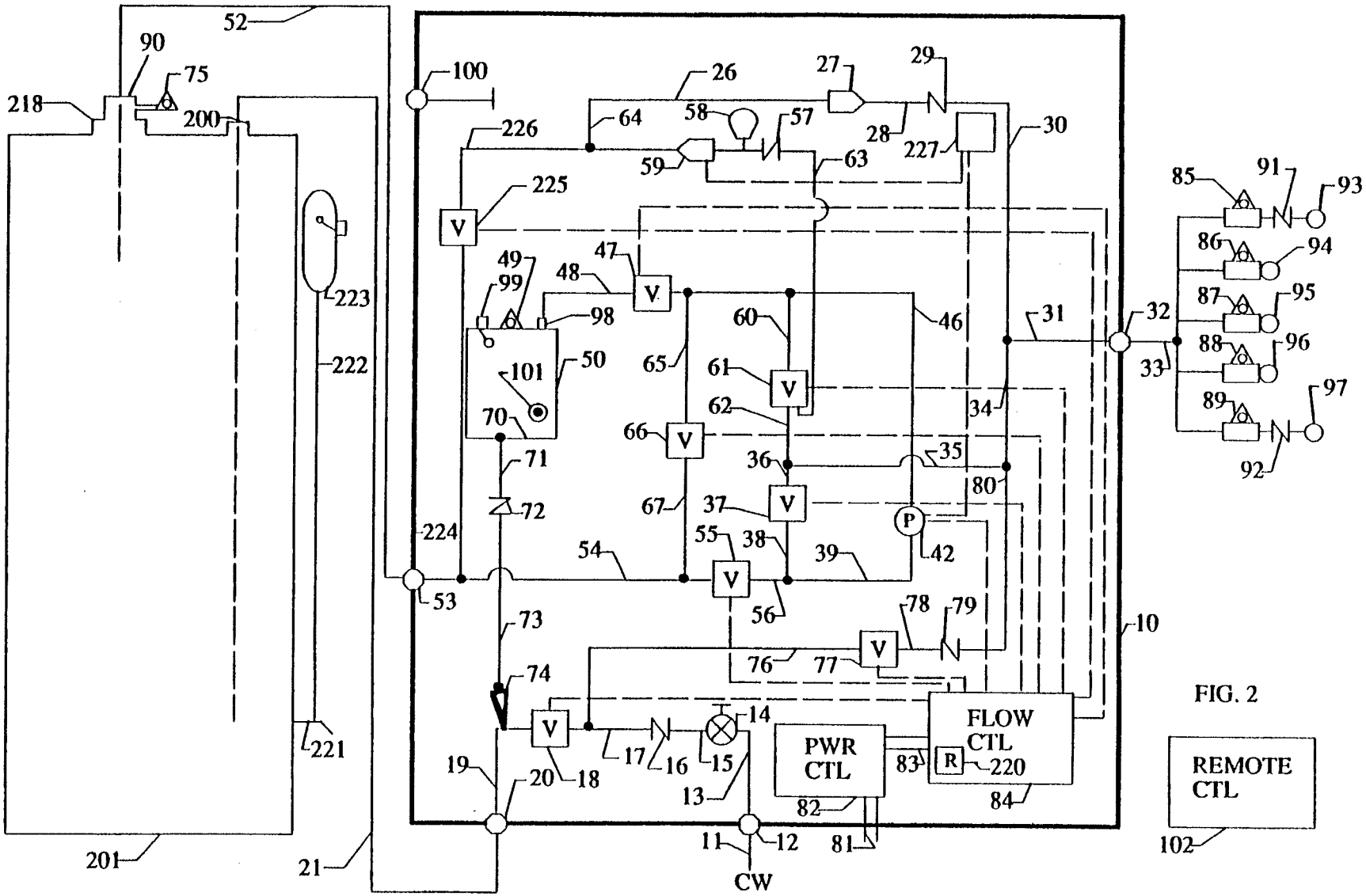
FIG. 2 is a flow diagram of a hot water distribution system, with an alternate embodiment of the present invention, utilizing a conventional, single hot water outlet, water heater and a hydraulic accumulator system.
Figure 3:
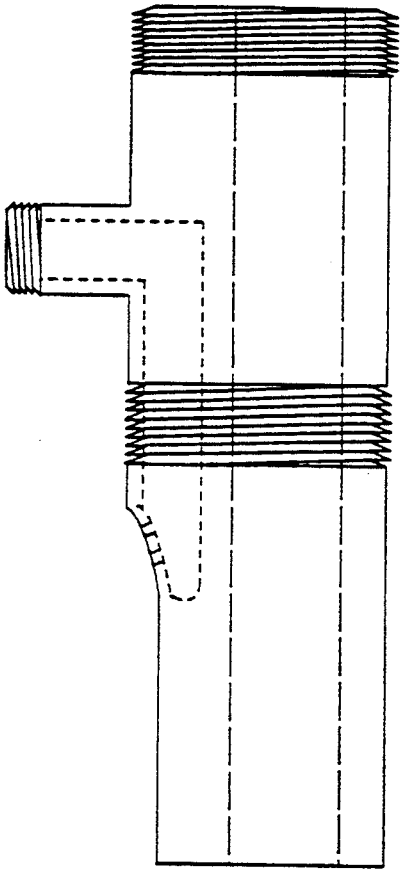
FIG. 3 is a view of a preferred embodiment of a vent nipple.
Figure 4:
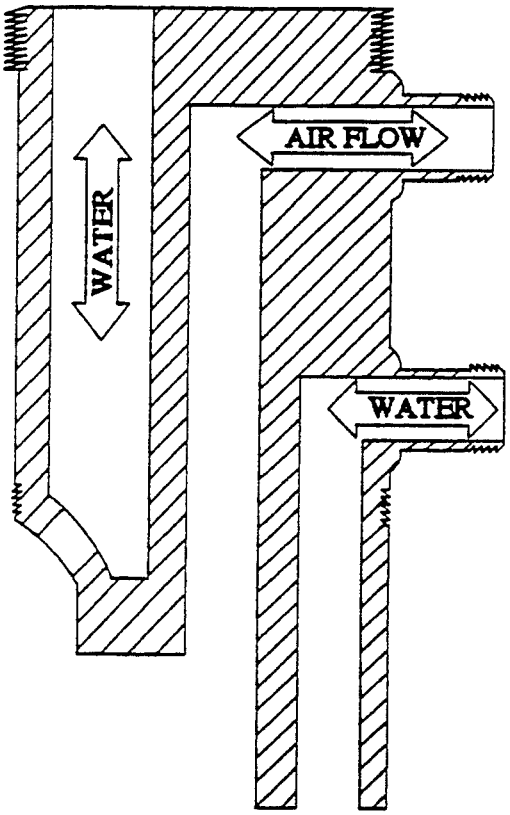
FIG. 4 is a view of a preferred embodiment of a vent relief split flow nipple.
Figure 5:
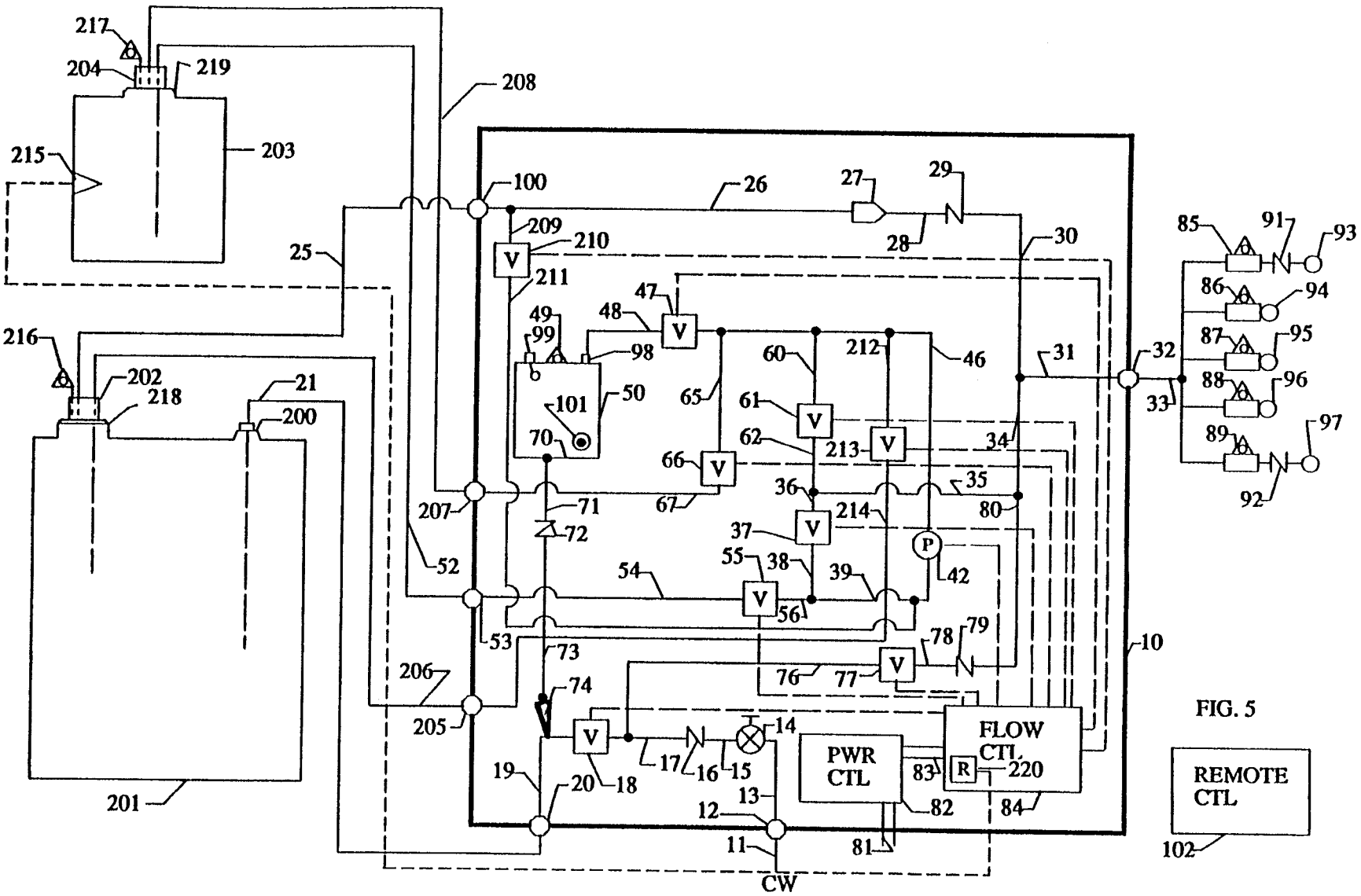
FIG. 5 is a flow diagram of a hot water distribution system with an alternate embodiment of the present invention utilizing a conventional, single hot water outlet, water heater and an insulated hot water holding vessel.

| LIST OF REFERENCE NUMERALS | |
|---|---|
| 48. | Conduit |
| 49. | Vent Relief Device |
| 50. | Cold Water Holding Tank |
| 51. | Inlet/Outlet small Chamber 23b |
| 52. | Conduit |
| 53. | Dual Purpose Inlet/Outlet |
| 54. | Conduit |
| 55. | Remotely Actuated Valve |
| 56. | Conduit |
| 60. | Conduit |
| 61. | Remotely Actuated valve |
| 62. | Conduit |
| 63. | Unused |
| 64. | Conduit |
| 65. | Conduit |
| 66. | Remotely Actuated Valve |
| 67. | Conduit |
| 68. | Unused |
| 69. | Conduit |
| 70. | Outlet Cold Water Holding Tank |
| 71. | Conduit |
| 72. | Check Valve |
| 73. | Conduit |
| 74. | Venturi |
| 75. | Vent Relief |
| 76. | Conduit |
| 77. | Remotely Actuated Valve |
| 78. | Conduit |
| 79. | Check Valve |
| 89. | Conduit |
| 81. | Electrical Power |
| 82. | Power Control |
| 83. | Electrical Lines |
| 84. | Flow Control |
| 85. | Vent Relief Flow Device |
| 86. | Vent Relief Flow Device |
| 87. | Vent Relief Flow Device |
| 88. | Vent Relief Flow Device |
| 89. | Vent Relief Flow Device |
| 90. | Vent Relief Nipple |
| 91. | Check Valve |
| 92. | Check Valve |
| 93. | Hot Water Outlet |
| 94. | Hot Water Outlet |
| 95. | Hot Water Outlet |
| 96. | Hot Water Outlet |
| 97. | Hot Water Outlet |
| 98. | Inlet Cold Water Holding Tank |
| 99. | Float Switch |
| 100. | Inlet |
| 101. | Manual Drain Valve |
| 102. | Remote Control |
| FIG. 2 | |
| 57. | Check Valve |
| 58. | Hydraulic Accumulator |
| 59. | Flow Switch |
| 221. | Drain Faucet Fitting |
| 222. | Conduit |
| 223. | Float Switch |
| 224. | Conduit |
| 225. | Remotely Actuated Valve |
| 226. | Conduit |
| 227. | Time Delay |
| FIG. 5 | |
| 200. | Cold Water Inlet |
| 201. | Conventional Water Heater |
| 202. | Vent Relief Split Flow Nipple |
| 203. | Insulated Hot Water Holding Vessel |
| 204. | Vent Relief Split Flow Nipple |
| 205. | Flow Control and Recovery Apparatus Outlet |
| 206. | Conduit |
| 207. | Flow Control and Recovery Apparatus Outlet |
| 208. | Conduit |
| 209. | Conduit |
| 210. | Remotely Actuated Valve |
| 211. | Conduit |
| 212. | Conduit |

-continued

Figure 6:
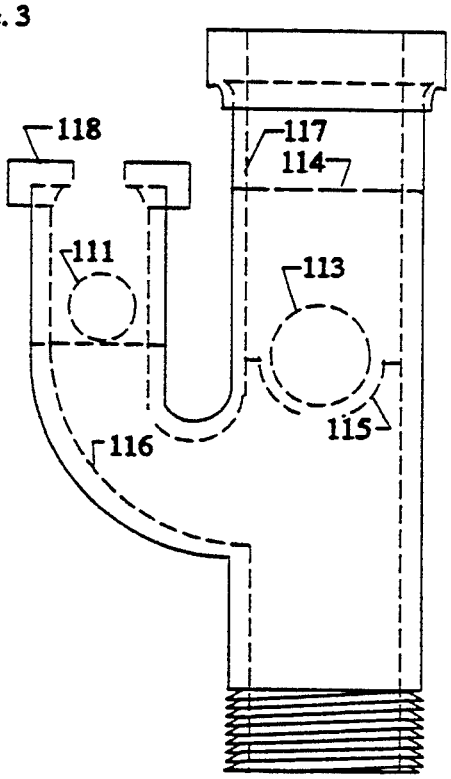
FIG. 6 is a view of a preferred embodiment of a vent relief flow device.

| LIST OF REFERENCE NUMERALS | |
|---|---|
| 213. | Remotely Actuated Valve |
| 214. | Conduit |
| 215. | Thermal Sensor Switch |
| 216. | Vent Relief Device |
| 217. | Vent Relief Device |
| 218. | Dual Purpose, Inlet Outlet |
| 219. | Dual Purpose, Inlet Outlet |
| 220. | Relay |
| FIG. 6 | |
| 111. | Float Ball |
| 112. | Perforated Retaining Screen |
| 113. | Weighted Ball |
| 114. | Perforated Retaining Screen |
| 115. | Weighted Ball Seat |
| 116. | Air Channel |
| 117. | Flow Channel |
| 118. | Air Vent Cap |

DESCRIPTION OF THE PREFERRED EMBODIMENTS

Precisely described below is a fluid flow control system which may be actuated by remote command, configured as a hot water recovery system. The hot water recovery system, having a flow control and recovery apparatus 10 and a dual chamber, dual hot water outlet, water heating reservoir 23, in fluid communication with each other and in fluid communication with a pressurized cold water supply 11 and a plurality of hot water outlets 93–97. The hot water recovery system having a power source 81, is activated by a remote control 102 which activates a power control 82, energizing a flow control 84. Flow control 84 initiates a predetermined series of open-to-flow and closed-to-flow remotely actuated valve control functions. The sequence of pre-programmed functions enables flow control and recovery apparatus 10 to systematically alter its internal conduit paths and the operation of a pump 42. Upon receiving a start command from control 102, the hot water recovery system, in its herein described configuration completes the following functions, in the following order:

- Prime flow control and recovery apparatus 10, from pressurized cold water supply 11.
- Drain standing water from hot water outlets 93–97 to a cold water holding tank 50.
- Fill drained hot water outlets 93–97 with hot water from a small chamber **23*b* of dual chamber, dual hot water outlet water heating reservoir 23**.
- Utilize hot water supply from a large chamber **23*a* of dual chamber, dual hot water outlet, water heating reservoir 23, in fluid communication with pressurized cold water supply 11**, until hot water usage is completed.
- Drain hot water remaining in hot water outlets 93–97 and return to small chamber **23*b* of dual chamber, dual hot water outlet water heater 23**.
- Refill the remote hot water outlets 93–97 with fresh cold water.
- Return flow control and recovery apparatus 10 to a normal standby state.

OPERATIONS FIG. 1, 2 and 5

Turning now to FIG. 1, before a command is received the programmed operation of flow control 84 is actuated, flow control and recovery apparatus 10 is in a static state, in communication with a pressurized cold water supply 11 and dual chamber, dual hot water, outlet water heating reservoir 23. A continuous conduit path is complete from pressurized cold water supply 11 entering flow control and recovery apparatus inlet 12, coupled to conduit 13 and through a manual shut off valve 14. In operation, manual shut off valve 14 is opened and flow continues through conduit 15 and a check valve 16, which prevents back flow into cold water supply 11. Conduit 17 directs the flow to the deactuated, normally open-to-flow, remotely actuated valve 18 and through conduit 19. Cold water supply flows out of flow control and recovery apparatus outlet 20 and connecting conduit 21 to an inlet 22 of dual chamber, dual hot water outlet, water heating reservoir 23 and into large chamber 23*a*. Opening any hot water outlet permits supply pressure to direct hot water from large chamber 23*a* at outlet 24. The flow path continues through conduit 25 and flow control and recovery apparatus inlet 100, thence via conduit 26 to flow switch 27, conduit 28 and through a check valve 29 which prevents back flow. The flow path is completed through conduits 30 and 31 to flow control and recovery apparatus outlet 32, thence via conduit 33 to the hot water outlets 93–97. Each outlet is branched with a vent relief flow device 85–89 which permits ingress and egress of air into outlet lines during operation. Outlet lines to a dishwasher and clothes washer include a check valve 91 and 92 preventing back flow from these appliances into the system. This completes static flow path from cold water supply 11 through dual chamber, dual outlet, water heater 23, and flow control and recovery apparatus 10 to hot water outlets 93–97.

Upon initial installation, conduits of flow control and recovery apparatus 10 and plumbing lines are filled with water. The recovery apparatus 10 is actuated by receiving a start signal, from remote control 102, and a power control 82 energizes a flow control 84 which steps through a sequence of events.

PRIMING SYSTEM

Remotely actuated valve 18 which is normally in open-to-flow position, is actuated by flow control 84, to the closed-to-flow position, thus interrupting cold water supply 11 at conduit 17. A remotely actuated valve 37 normally closed-to-flow is actuated to open-to-flow condition. A remotely actuated valve 77, normally closed-to-flow, is actuated to open-to-flow position to permit cold water supply pressure to flow from conduit 76. A conduit path from the cold water supply 11 is via flow control and recovery apparatus inlet 12, conduit 13, manual shut off valve 14, conduit 15, check valve 16, and thence via conduits 17 and 76 to the input of remotely actuated valve 77, now open-to-flow. The conduit path is completed from the output of remotely actuated valve 77 through conduit 78 and a check valve 79, through conduits 80, 35, 36, through actuated, remotely actuated valve 37, now open-to-flow. Conduits 38 and 39 direct flow to inlet port of pump 42, priming flow control and recovery apparatus 1O.

DRAINING COLD WATER FROM HOT WATER LINES

After priming cycle is completed, flow control 84 controls remotely actuated valve operations, so that remotely actuated valve 18 remains in the closed-to-flow position and remotely actuated valve 77 is de-actuated to the close-to-flow position, causing cold water supply 11 to be interrupted and held at conduits 17 and 76. A remotely actuated valve 47 normally closed-to-flow is actuated to the open-to-flow position. Remotely actuated valve 37 remains in open-to-flow position. A completed conduit path is thus established between hot water outlets 93–97 and cold water holding tank 50. Flow control 84 actuates pump 42. With zero pressure at hot water outlets 93–97 and with pump 42 in operation, atmospheric pressure acting on vent relief flow devices 85–89 permits air to enter hot water outlet lines. Water is drawn by pump 42 on a continuous conduit path to the pump inlet from hot water outlets 93–97 which are in communication with hot water supply conduit 33. Water from hot water outlets 93–97 is drained through conduit 33, 31, flow control and recovery apparatus dual purpose, inlet outlet 32 and conduits 34, 35 and 36 and through actuated open-to-flow, remotely actuated valve 37. The flow path continues through conduits 38, 39, to input port of pump 42. Output of operating pump 42 flows via conduit 46, and actuated remotely actuated valve 47, now open-to-flow, thence via conduit 48 to an inlet 98 to cold water holding tank 50 and pump 42 evacuates water in hot water outlets 93–97, of cold water holding tank 50. At the completion of the drain period, flow control 84 de-actuates remotely actuated valve 37 to the normally closed-to-flow condition and remotely actuated valve 47 to the normally closed-to-flow condition. Remotely actuated valves 18 and 77 remain in the closed-to-flow condition.

FILL DRAINED LINES WITH HOT WATER

Flow control 84 next actuates pump 42, and a remotely actuated valve 55, normally closed-to-flow, to the open-to-flow position and a remotely actuated valve 61, normally closed-to-flow, to the open-to-flow position. Operating pump 42 draws hot water from small chamber 23*b* of dual channel, dual hot water, water heating reservoir 23 as a continuous conduit path is established through small chamber 23*b*, outlet 51, and vent relief nipple 90, which permits air to enter in and exhaust from small chamber 23*b*. The flow path continues through conduit, 52, flow control and the recovery apparatus dual purpose, inlet outlet 53, conduit 54, and open-to-flow remotely actuated valve 55. The conduit path is completed from output port of open-to-flow remotely actuated valve 55 via conduits 56, and 39, through to the inlet of pump 42. Flow from output side of operating pump 42 is via conduits 46 and 60 to input side of actuated, and open-to-flow remotely actuated valve 61. The flow continues through conduit 62, through conduits 35, 34 and 31, to flow control and recovery apparatus dual purpose, inlet outlet 32 thence via conduit 33 to a plurality of hot water outlets 93–97, refilling drained hot water outlets with hot water. Air which entered lines is vented through vent relief flow devices 85–89.

After completion of the hot water line fill function, flow control 84 causes the de-activation of pump 42 and remotely actuated valves 55, and 61 to their respective closed-to-flow condition. Remotely actuated valve 18 is de-energized to its normal open-to-flow position, causing cold water supply 11 pressure to be applied to the plumbing system.

NORMAL USE OF HOT WATER

At this point in the flow control sequence, all remotely actuated remotely actuated valves are in their de-actuated state. Remotely actuated valve 18 being the only remotely actuated valve in the normally open-to-flow condition, thus hot water is available at remote hot water outlets 93–97 on demand. Normal supply pressure is restored and hot water flow is available through the standard operation of pressurized plumbing system. Cold water supply exerts pressure on dual chamber, dual hot water outlet, water heating reservoir 23 through a continuous conduit path, as it is in fluid communication with flow control and recovery apparatus inlet 12 then via conduit 13 and opened shut off remotely actuated valve 14, conduit 15 and check remotely actuated valve 16; thence via conduit 17 to inlet side of remotely actuated valve 18. De-actuated, normally open-to-flow, remotely actuated valve 18 directs flow through conduit 19 and flow control and recovery apparatus outlet 20 via conduit 21 and inlet 22 of large chamber 23*a* of dual chamber, dual hot water outlet, water heating reservoir 23. Cold water supply pressure 11 now being exerted on large chamber 23*a* causes heated water to flow when any hot water outlet is opened. The hot water flow path is from large chamber 23*a* via outlet 24 and conduit 25 to flow control and recovery apparatus inlet 100, Flow then is through conduit 26, flow switch 27, conduit 28, and check valve 29, which prevents cold water back flow. Hot water flow continues via conduits 30 and 31 and flow control and recovery apparatus outlet 32 thence via conduit 33 through vent relief flow devices 85–89 to outlets 93–97.

During periods when any hot water outlet is opened, holding tank 50 is drained of cold water from outlet 70 via conduit 71, a check valve 72, conduit 73, and a venturi 74 to conduit 19 and through flow control and recovery apparatus outlet 20, conduit 21 to cold water inlet 22 of the large chamber 23*a*.

Hot water flow through conduit 26, flow switch 27 causes flow control 84 to be held in a standby condition. When hot water flow is interrupted through flow switch 27, flow control 84 is actuated and continues its programmed cycle. At a predetermined elapsed time of non-flow of hot water, flow control 84 automatically actuates flow control and recovery apparatus 10 into configuration necessary to recover hot water from hot water outlets 93–97, to small chamber 23*b*, of dual chamber, dual hot water outlet heating reservoir 23.

RECLAIM HOT WATER LINES

At the next flow control 84 sequence, normally open-to-flow remotely actuated valve 18 is actuated to the closed-to-flow condition, interrupting cold water supply 11 to dual chamber, dual hot water outlet, water heating reservoir 23. Pump 42 is actuated and a remotely actuated valve 66, and remotely actuated valve 37 are actuated to open-to-flow condition. Remaining remotely actuated valves 55, 61, 47, 18, 77 are in closed-to-flow position. A continuous flow path is completed from the hot water outlets 93–97, through conduits 33, flow control and recovery apparatus dual purpose inlet outlet 32. Conduits 31, 34, 35 and 36 through remotely actuated valve 37, and conduit 38, and 39, to input side of pump 42. Flow from output, side of operating pump 42 follows a completed conduit path via conduits 46 and 65, through actuated, remotely actuated valve 66, now in open-to-flow position. Output flow of remotely actuated valve 66 is via conduit 67, thence conduit 54 to flow control and recovery apparatus dual purpose, inlet outlet 53. The flow path is completed through conduit 52, directing flow through vent relief nipple 90, venting chamber air out of small chamber 23*b* and allowing recovered hot water to refill vacant small chamber 23*b*.

With zero pressure in lines, and cold water supply pressure being interrupted by close-to-flow remotely actuated valve 18, atmospheric pressure and actuated pump 42 combine to drain water from hot water outlets 93–97; vent relief flow devices 85–89 open allowing air to enter lines. Upon completion of hot water recovery function, flow control 84 de-actuates pump 42 and de-actuates remotely actuated valves 37, and 66 to the normally close-to-flow position.

REFILL LINES WITH FRESH COLD WATER

Flow control 84 causes normally open-to-flow remotely actuated valve 18 to remain actuated in closed-to-flow position; all of the previously actuated remotely actuated valves are de-actuated to the normally closed-to-flow position. Normally closed-to-flow remotely actuated valve 77 is actuated to the open-to-flow condition. A continuous conduit path is formed between cold water supply 11 and hot water outlets 93–97 via conduit 13 through opened shut-off valve 14, conduit 15, check valve 16, conduits 76 and actuated remotely actuated valve 77. The output of valve 77 is coupled through conduit 78, check valve 79, and conduit 80, thence via conduits 34 and 31 to flow control and recovery apparatus dual purpose, inlet outlet 32; thence via conduit 33, vent relief flow devices 85–89, and to hot water outlets 93–97. Supply pressure refills hot water lines with fresh cold water as air in lines is evacuated through vent relief flow devices 85–89 and any additional vent relief flow devices which may be installed at any additional hot water outlets.

RETURN TO STATIC CONDITION

Flow control 84 completes its cycle, all remotely actuated valves 18, 37, 47, 55, 61, 66 and 77 are returned to the de-actuated position, In event of system power loss hot water supply 11, dual chamber, dual hot water outlet, water heating reservoir 23, and flow control and recovery apparatus 10 will function as any standard hot water system.

Float switch 99 turns off power to pump should tank 50 overfill.

Vent Relief device 49 permits the ingress and egress of air into and out of tank 50 and closes in event of tank overfill.

Manual drain valve 101 for manually draining cold water holding tank 50.

Turning now to FIG. 2, there is shown an alternative embodiment of the present invention. An on demand hot water recovery system, which includes pressurized water supply 11 in fluid communication with flow control and recovery apparatus 10 which is also in fluid communication with a conventional water heater 201 and an hydraulic accumulator system comprising a hydraulic accumulator 58, a flow switch 59, a check valve 57, a conduit 63, 64; and a normally open-to-flow, remotely actuated valve 225, with a conduit, 224, and a conduit 226.

This embodiment operates correspondingly, in the previously explained manner, during all the sequences except the hot water use sequence. The flow control 84 steps through the hot water outlets draining sequence and the hot water outlets refilling sequence. After hot water has been pumped from hot water heater 201, to refill drained hot water outlets 93–97 an air chamber exists within the hot water heater 201 as cold water supply 11 to water heater 201 has been interrupted by the closure of normally open-to-flow, remotely actuated valve 18. At this point flow control 84 configures the flow control and recovery apparatus 10 for the hot water use sequence.

Flow control 84 furnishes power to the switch contacts of float switch 223, and to the contacts of flow switch 59 and to pump 42 and remotely actuated valve 18 is de-actuated to the open-to-flow position. Flow control 84 actuates normally closed-to-flow, remotely actuated valves 55, 61, to the open-to-flow position and actuates normally open-to-flow, remotely actuated valve 225, to the closed-to-flow position.

The pressure of the cold water supply 11 causes cold water to begin to flow into water heater 201. Pump 42 is actuated and pumps hot water out of water heater 201. Float switch means 223 has a dual level sensing capability to provide for the maintenance of an air space within water heater 201, for later refilling, when hot water is returned from the hot water outlets, once the hot water use sequence is completed.

During the use period cold water enters the water heater 201 at the same time pump 42 is pumping hot water from the water heater 201 to the hot water outlets 93–97. Float switch 223 will actuate normally open-to-flow, remotely actuated valve 18 to the closed-to-flow position when it senses the water in the water heater 201 has risen to a set point. The float switch reacts similarly when the water level within water heater 201 drops below a set point, de-actuating remotely activated valve 18 permitting cold water to enter the water heater. The periodic interruption of the cold water supply 11 ensures the amount of incoming cold water will not exceed the pumped hot water outflow and thus an adequate air space in the water heater 201 is maintained.

A completed conduit path is completed from the hot water outlet 218 of hot water heater 201 through vent relief nipple 90 conduit 52 to the flow control and recovery apparatus dual purpose inlet outlet 53, thence through conduit 54 to the inlet of remotely actuated valve 55, now actuated to the open-to-flow position.

The output of remotely actuated valve 55 is coupled to conduit 56, thence to conduit 39 to the input of the actuated pump 42. The output of pump 42 is coupled via conduits 46 and 60 to the input of remotely actuated valve 61, now in the open-to-flow position.

The pumped hot water flow from the output of remotely actuated valve 61 is coupled, via conduit 63 and a check valve 57 to the inlet port of hydraulic accumulator 58.

The flow control 84 in this described state enables flow switch 59 to control power to pump 42 during periods when hot water flows out through one or more opened hot water outlets 93–97. When hot water flow is interrupted the flow switch 59 opens and a time delayed circuit 227 permits pump 42 to continue to operate for a predetermined period of time, to deliver hot water to the hydraulic accumulator 58, compressing the air within, thus creating a store of water pressure, then pump 42 is deactuated.

With hot water flow interrupted flow switch 27 is closed and applies power to the flow control 84 which then continues its cycle, which is interrupted whenever hot water is flowing through flow switch 27.

Opening one or more hot water outlets 93–97 will cause the pressure in the output side of hydraulic accumulator 58 to be less than the pressure within hydraulic accumulator 58 and the store of water pressure reacts towards the hot water outlets 93–97, through flow switch 59, aided by the blocking action of check valve 57. The water flow causes flow switch 59 to make contact which immediately actuates pump 42 which begins to again pump hot water to the open hot water outlet from the hot water heater 201. Flow through flow switch 27 causes flow control 84 to interrupt its progress, Flow control 84 will continue in this standby state throughout the hot water use period.

At the conclusion of hot water usage, float switch 59 interrupts power to pump 42 and flow switch 27 applies power to flow control 84, which then continues on with its programed sequence of draining hot water from hot water outlets 93–97, to refill the space which had been maintained within the hot water heater 201.

After the draining of the hot water is accomplished the cold water refill sequence is actuated, as previously detailed under the heading . . . Refill Lines with Cold Water. At the conclusion of this function, flow control 84 interrupts power to float switch 223 and remotely actuated valves 18 and 225 are de-actuated to their normally open-to-flow positions. Cold water supply 11 is coupled to the hot water heater 201 and cold water fills any remaining space in hot water heater 201 as air in the hot water heater 201 is vented through a vent relief device 75 coupled to the vent relief nipple 90. In the event of power failure the hot water recovery system functions as a conventional hot water distribution system.

Turning now to FIG. 5, there is shown an alternative embodiment of the present invention. An on demand hot water recovery system, which includes pressurized water supply 11 in fluid communication with flow control and recovery apparatus 10 which is also in fluid communication with a conventional water heater 201 and a hot water holding vessel 203, sufficiently insulated.

A vent relief split flow nipple 202 is coupled to the hot water outlet of the hot water heater with one channel coupled to the recovery apparatus outlet 205 through conduit 206 and one channel coupled to flow control and recovery apparatus dual purpose inlet outlet 100, through conduit 25.

A vent relief split flow nipple 204 is coupled to the dual purpose, inlet outlet 219 of the hot water holding vessel 203. One channel is coupled to flow control and recovery apparatus dual purpose inlet outlet 207 through conduit 208 and one channel is in fluid communication with flow control and recovery apparatus dual purpose inlet outlet 53, through conduit 52. In the static state remotely actuated valves 55, 66, 210, and 213 are in a normal closed-to-flow condition. Remotely actuated valve 18 is in its normal, open-to-flow position.

Thermal sensor switch 215 reacts when the temperature of the hot water in the hot water holding vessel 203 cools below a set temperature, and causes thermal switch relay 220 to close, applying power to remotely actuated valves 18, 55, 66, 210, 213 and pump 42. The actuation of, normally open-to-flow remotely actuated valve means 18 to the close-to-flow position causes interruption of water supply 11 pressure, to water heater 201.

The energizing of thermal switch relay 220 causes actuated valves and conduits to form a dual flow path into and out of the hot water outlet 218, of water heater 201, and a dual flow path into and out of hot water holding vessel 203. When thermal switch relay 220 is energized, recovery apparatus 10, is automatically configured to permit pump 42 to circulate water simultaneously to and from hot water holding vessel 203 and to and from water heater 201.

A first conduit path to the input side of pump 42 is completed from the hot water holding vessel 203 through one channel of vent relief split flow nipple, 204, conduit 52 and flow control and recovery apparatus, dual purpose, inlet 53 through conduit 54 to the input of open-to-flow remotely actuate valve 55. The output of remotely actuated valve 55 is coupled by conduit 56 to conduit 39 and then the input side of actuated pump 42.

A second conduit path to the input side of pump 42 is completed from the water heater 201 through one channel of vent relief split flow nipple 202 coupled to conduit 25 to flow control and recovery apparatus dual purpose inlet outlet 100 and conduit 209 to the input of the open-to-flow remotely actuated valve 210. The output side of open-to-flow remotely actuated valve 210 is coupled by conduit 211, to conduit 39, to the input side of pump 42.

A dual flow path is created from the output side of pump 42. The path to hot water holding vessel 203 is from the output of pump 42 through conduit 46, coupled to conduit 65, to the input side of open-to-flow remotely actuated valve 66. The output of remotely actuated valve 66 is coupled to conduit 67, to flow control and recovery apparatus outlet 207 and conduit 208 to one channel of vent relief split flow nipple 204 and to hot, water holding vessel 203.

The path to water heater 201 from the output of pump 42 is through conduit 46, conduit 212 to the input of open-to-flow, remotely actuated valve 213. The output of remotely actuated valve 213 is through conduit 214 to flow control and recovery apparatus outlet 205 and thence through conduit 206, to one channel of vent relief split flow nipple 202 to hot water heater 201.

Actuated pump 42 circulates cooled hot water from hot water holding vessel 203 to water heater 201 and at the same time circulates hot water from water heater 201 to hot water holding vessel 203. By this periodic circulation, the temperature of the water in hot water holding vessel 203 is maintained at a readiness level for lilting, upon command, the drained hot water outlets 93–97, with hot water.

When the temperature in the holding vessel 203 reaches the desired temperature, thermal sensor switch 215 de-energizes thermal switch relay 220 which deactivates remotely actuated valves 55, 66, 210, 213 and pump 42, returning the hot water recovery system to a readiness configuration. Remotely actuated valve 18 is de-actuated and returned to its normally open-to-flow condition, which causes water supply 11 to be in fluid communication with cold water inlet 200 of water heater 201.

The primary operational functions of the flow control and recovery apparatus 10, are correspondingly the same. Priming the system, draining the hot water outlets, filling the hot water outlets, recovering unused hot water from the outlets, and refilling hot water outlets with cold water, remain under the direction of the programmed flow control 84, as previously explained.

Ramifications

While certain specific embodiments, parts, and connections have been shown, various additional ramifications can be provided.

A further ramification is the use of the system to control, condition, blend, mix, etc., fluids other than heated water. The fluid conditioning can be any of a variety of activities such as heating, cooling or adding a solution.

Another ramification of the system is a drain capability for the cold water holding tank, for directing cold water to a drip irrigation system, a washing machine, some other device or holding vessels.

Still another ramification of the invention is a portable version which could be temporarily installed by lessees of leased structures who desire to conserve water and reduce utility costs by saving energy consumption.

Still other ramification is the system in operation with a bi-directional pump and three-way and four-way remotely actuated valves.

The present disclosure includes that contained in the appended claims as well as that of the foregoing description. It is understood that the present disclosure of the preferred forms has been made only by way of example. Although preferred and alternate embodiments of the present invention have been disclosed above, it will be appreciated that numerous alterations and modifications thereof will no doubt become apparent to those skilled in the art, after having read the above disclosures. It is therefore intended that the following claims be interpreted as covering all such alterations and modifications as fall within the true spirit and scope of the invention.

What is claimed is:

1. In a plumbing system which has a pressurized cold water supply, having a cold water supply conduit for the purpose of coupling the cold water supply to a cold water inlet of a water heating reservoir and having a hot water supply conduit for the purpose of coupling the hot water outlet of said water heating reservoir, to a plurality of hot water outlets, a hot water recovery system, remotely controlled, which installs in existing structures without requiring the installation of additional plumbing lines, and for supplying hot water on command and for, upon completion of use, automatically and rapidly returning unused hot water from the hot water outlets, to the water heating reservoir, comprising in combination:

(a) a flow control and recovery apparatus;

(b) a dual chamber, dual hot water outlet, water heating reservoir;

(c) said flow control and recovery apparatus and said dual chamber, dual hot water outlet water heating reservoir, in fluid communication and being interposed between said cold water supply conduit and said hot water supply conduit;

(d) a power source;

(e) a vent, relief nipple;

(f) a vent relief flow device;

(g) a pump means, for pumping water into and out of the recovery system and the plumbing system;

(h) a power control means, remotely actuated, for the purpose of supplying, on command, power to the hot water recovery system;

(i) a remote control means to transmit a command to said power control means;

(j) a flow control means for actuating and deactuating, at the proper times and in the proper sequences, remotely actuated valve means, which control flow, individually and in combinations, and for actuating and deactuating said pump means;

(k) a remotely actuated valve means and the conduit means for the purpose of permitting the interruption of the cold water supply to the plumbing system, and the water heating reservoir;

(l) a cold water holding tank to capture cold water evacuated from said hot water outlets;

(m) a remotely actuated valve means and the conduit means to couple the hot water outlets to the inlet side of said pump means and a second remotely actuated valve means and the conduit means coupled between the outlet side of said pump means and said cold water holding tank, acting in combination with the actuated pump means to evacuate standing cold water from said hot water outlets, to said holding tank;

(n) a large chamber within said dual chamber, dual hot water outlet, water heating reservoir, having a cold water inlet in fluid communication with said flow control and recovery apparatus and the conduit means, which is coupled to said pressurized cold water supply, and with a hot water outlet which is in fluid communication with said flow control and recovery apparatus and the conduit means, in fluid communication with said hot water outlets;

(o) a small chamber, located within said large chamber of said dual chamber, dual hot water outlet, water heating reservoir, with a dual purpose fitting functioning as an inlet to and outlet from, said small chamber;

(p) said vent relief nipple coupled to said dual purpose, inlet outlet of said small chamber, in fluid communication with said flow control and recovery apparatus, which permits the bi-directional transfer of hot water between said hot water outlets, and said small chamber, said vent relief nipple being constructed with a fluid passage and a separate air passage;

(q) a vent relief means coupled to said vent relief nipple, to permit the ingress and egress of air in to and out of said small chamber of said water heating reservoir during the filling and draining sequences of said small chamber;

(r) a remotely actuated valve means and conduit means to connect the vent relief nipple coupled to said dual purpose, inlet outlet of said small chamber, to the inlet side of said pump means and a second remotely actuated valve means and the conduit means coupled between the outlet side of said pump means and the hot water outlets, acting in combination with the actuated said pump means, to fill evacuated hot water outlets with hot water from said small chamber;

(s) a remotely actuated valve means and conduit means to couple the hot, water outlets to the inlet side of said pump means and a remotely actuated valve means and the conduit means, coupled between the outlet side of said pump means and the vent relief nipple coupled to said small chamber acting in combination with the actuated pump means, to permit the return of hot water from said hot water outlets to said small chamber;

(t) a remotely actuated valve means and conduit means which couples the cold water supply, through the recovery apparatus, to the cold water inlet of said large chamber of said dual chamber, dual hot water outlet heating reservoir and the conduit means coupling the hot water outlet of said large chamber to the recovery apparatus, in fluid communication with said hot water outlets, to permit hot water to be directed to any of the hot water outlets which may be opened;

(u) a remotely actuated valve means and the conduit means to couple the cold water supply to the evacuated hot water outlets, for the purpose of refilling the outlets with fresh cold water;

(v) a check valve to prevent hot water from back flowing into said cold water supply;

(w) a flow switch means in fluid communication with the hot water outlet of the large chamber of the water heating reservoir and the hot water outlet conduit, to control power to the said flow control means, during the hot water use sequence;

(x) a venturi means coupled between said cold water holding tank and the cold water supply conduit of the large chamber to drain captured cold water, from said cold water holding tank, into the large chamber;

(y) a float switch means incorporated into said cold water holding tank which interrupts power, in the event of tank overfill;

(z) a vent-relief means incorporated in said cold water holding tank, which permits the ingress and egress of air to and from said cold water holding tank;

(aa) a vent-relief flow device coupled to the upstream side of each hot water outlet, which permits the ingress and egress of air, and permits water flow to the attached outlet.

2. The system according to claim 1 wherein the actuating power may be electrical, pneumatic, hydraulic or any combination of the above.

3. A system, according to claim 1, wherein a remotely actuated blending valve means and the conduit means is installed, actuated and deactuated by remote command or by manual operation, being interposed between the cold water supply line and the hot water supply outlet of the flow control and recovery apparatus, to moderate the temperature of the hot water to the remote hot water outlets; a control valve means for regulating the amount of cold water supplied to the input of said blending valve means.

4. In a plumbing system which has a pressurized cold water supply, having a cold water supply conduit for the purpose of coupling the cold water supply to a cold water inlet of a water heater and having a hot water supply conduit for the purpose of coupling the hot water outlet, of said water heater, to a plurality of hot water outlets, a hot water recovery system, remotely controlled, for supplying hot water on command and for, upon completion of use, automatically and rapidly, recovering unused hot water from the hot water outlets, remotely controlled, comprising in combination;

(a) a flow control and recovery apparatus;

(b) a conventional water heater in fluid communication with said flow control and recovery apparatus;

(c) said flow control and recovery apparatus and said water heater, fluid communication and being interposed between said cold water supply conduit and said hot water supply conduit;

(d) a pump means, for pumping water into and out of the recovery system and the plumbing system;

(e) a power source;

(f) a power control means, remotely actuated, for the purpose of supplying, on command, power to the hot water recovery system;

(g) a remote control means to transmit a command to said power control means;

(h) a flow control means for actuating and deactuating, at the proper times and in the proper sequences, remotely actuated valve means which control flow, individually and in combinations, and for actuating and deactuating said pump means;

(i) a check valve to prevent system back flow into said cold water supply;

(j) a remotely actuated valve means and the conduit means for the purpose of permitting the interruption of the cold water supply to said plumbing system, and said water heater;

(k) a cold water holding tank to capture cold water evacuated from said hot water outlets;

(l) a remotely actuated valve means and the conduit means to couple the hot water outlets to the inlet side of said pump means and a second remotely actuated valve means and conduit means coupled between the outlet side of said pump means and said cold water holding tank, acting in combination with the actuated pump means to evacuate standing cold water from said hot water outlets, to said cold water holding tank;

(m) a vent relief nipple coupled to a dual purpose, inlet outlet of said water heater, in fluid communication with said flow control and recovery apparatus, which permits the two way transfer of hot water between said hot water outlets, and the water heater;

(n) a vent relief means coupled to said vent relief nipple, to permit the ingress and egress of air in to and out of said water heater during the hot water filling and draining sequences;

(o) a remotely actuated valve means and conduit means to connect the vent relief nipple coupled to said dual purpose, inlet outlet of the water heater, to the inlet side of said pump means and a second remotely actuated valve means and the conduit means coupled between the outlet side of said pump means and the hot water outlets, acting in combination with the actuated said pump means, to fill evacuated hot water outlets with hot water from the water heater;

(p) a remotely actuated valve means and conduit means which couples the cold water supply, through the recovery apparatus, to the cold water inlet of the water heater and the conduit means coupling the hot water outlet of said water heater to the recovery apparatus, in fluid communication with said hot water outlets, to permit hot water to be directed by cold water supply pressure, to any of said hot water outlets which may be opened;

(q) a remotely actuated valve means and conduit means to couple the hot water outlets to the inlet side of said pump means and a remotely actuated valve means and the conduit means, coupled between the outlet side of said pump means and the vent relief nipple coupled to said water heater dual purpose, inlet outlet acting in combination with the actuated pump means, to permit the return of hot water from said hot water outlets to said water heater;

(r) a float switch means, coupled to the said water heater for the purpose of regulating the in-flow of cold water from the cold water supply to said water heater, to permit the maintenance of an air space within said water heater;

(s) a hydraulic accumulator means, in fluid communication with said remote hot water outlets, for the purpose of building a store of water pressure;

(t) a flow switch means in fluid communication with said remote hot water outlet lines, which upon the opening of any hot water outlet, the said hydraulic accumulator pressure initiates flow through said flow switch means, which causes the actuation of said pump means;

(u) a vent relief means coupled to the air channel of said vent relief nipple which permits air to enter and exit said hot water heater:

(v) a time delayed control means, which permits said pump means (42) to continue to operate for a set period of time, after flow stops and said flow switch means opens, to permit the building of pressure in the hydraulic accumulator means;

(w) a remotely actuated valve means and the conduit means to couple the cold water supply to the evacuated hot water outlets, for the purpose of refilling the outlets with fresh cold water;

(x) a check valve to prevent hot water from back flowing into said cold water supply;

(y) a check valve to prevent cold water from back flowing into said hot water supply;

(z) a flow switch means, in fluid communication with the hot water outlet of said water heater and the hot water outlet conduit, which controls power to the said flow control means during the hot water use sequence;

(aa) a venturi means coupled between the cold water holding tank and the cold water supply conduit to drain captured cold water from said cold water holding tank to said water heater;

(bb) a check valve to prevent cold water supply from back flowing into said cold water holding tank;

(cc) a float switch means incorporated into said cold water holding tank which interrupts power in the event of tank overfill;

(dd) a vent-relief means incorporated in said cold water holding tank, which permits the ingress and egress of air to and from said cold water holding tank;

(ee) a vent relief flow means coupled to the upstream side of each hot water outlet, which permits the ingress and egress of air, and permits water flow to the attached outlet;

(ff) a remotely actuated valve means, to permit the interruption of the normal hot water flow path.

5. The system according to claim 4 which has a pressurized cold water supply, having a cold water supply conduit for the purpose of coupling the cold water supply to a cold water inlet of a water heater and having a hot water supply conduit for the purpose of coupling the hot water outlet, of said water heater, to a plurality of hot water outlets, a hot water recovery system which installs in existing structures without requiring the installation of additional plumbing lines, for supplying hot water on command and for, upon completion of use, automatically and rapidly returning unused hot water from the hot water outlet lines to the water heater, remotely controlled, comprising in combination:

(a) a flow control and recovery apparatus;

(b) a conventional water heater in fluid communication with said flow control and recovery apparatus;

(c) a hot water holding vessel, sufficiently insulated, in fluid communication with said conventional water heater and said flow control and recovery apparatus;

(d) said flow control and recovery apparatus and said water heater, in fluid communication and being interposed between said cold water supply conduit and said hot water supply conduit;

(e) a pump means, for pumping water into and out of the recovery system and the plumbing system;

(f) a power source;

(g) a power control means, remotely actuated, for the purpose of supplying, on command, power to the hot water recovery system;

(h) a remote control means to transmit a command to said power control means;

(i) a flow control means for actuating and deactuating, at the proper times and in the proper sequences, remotely actuated valve means, which control flow, individually and in combinations, and for actuating and deactuating said pump means;

(j) a check valve to prevent system back flow into said cold water supply;

(k) a remotely actuated valve means and the conduit means for the purpose of permitting the interruption of the cold water supply to said plumbing system, and said water heater;

(l) a cold water holding tank to capture cold water evacuated from said hot water outlets;

(m) a vent-relief split flow nipple;

(n) a vent-relief means;

(o) a remotely actuated valve means and the conduit means to couple the hot water outlets to the inlet side of said pump means and a second remotely actuated valve means and conduit means coupled between the outlet side of said pump means and said cold water holding tank, acting in combination with the actuated pump means to evacuate standing cold water from said hot water outlets, to said cold water holding tank;

(p) a vent-relief split flow nipple coupled to a dual purpose, inlet outlet of said hot water holding vessel, in fluid communication with said flow control and recovery apparatus, which permits the two way transfer of hot water between said hot water outlets, and the holding vessel and between the holding vessel and said water heater;

(q) a vent relief means coupled to said vent relief split flow nipple, to permit the ingress and egress of air in to and out of said water holding vessel during the hot water filling and draining sequences;

(r) a remotely actuated valve means and conduit means to connect the vent relief split flow nipple coupled to said dual purpose, inlet outlet of the holding vessel, to the inlet side of said pump means and a second remotely actuated valve means and the conduit means coupled between the outlet side of said pump means and the hot water outlets, acting in combination with the actuated said pump means, to fill evacuated hot water outlets with hot water from the holding vessel;

(s) a remotely actuated valve means and conduit means which couples the cold water supply, through the recovery apparatus, to the cold water inlet of the water heater and the conduit means coupling the hot water outlet of said water heater to the recovery apparatus, in fluid communication with said hot water outlets, to permit hot water to be directed by cold water supply pressure, to any of said hot water outlets which may be opened, acting as a bypass of said flow control and recovery apparatus control function;

(t) a remotely actuated valve means and conduit means to couple the hot water outlets to the inlet side of said pump means and a remotely actuated valve means and the conduit means, coupled between the outlet side of said pump means and the vent relief split flow nipple coupled to the holding vessel dual purpose, inlet outlet acting in combination with the actuated pump means, to permit the return of hot water from said hot water outlets to the holding vessel;

(u) a remotely actuated valve means and the conduit means to couple the cold water supply to the evacuated hot water outlets, for the purpose of refilling the outlets with fresh cold water;

(v) a check valve to prevent hot water from back flowing into said cold water supply;

(w) a check valve to prevent cold water from back flowing in said hot water supply;

(x) a flow switch means in fluid communication with the hot water outlet of said water heater and the hot water outlet conduit, which controls power to the said flow control means during the hot water use sequence;

(y) a venturi means coupled between the cold water holding tank and the cold water supply conduit to drain captured cold water from said cold water holding tank to said water heater;

(z) a check valve to prevent cold water supply from back flowing into said cold water holding tank;

(aa) a float switch means incorporated into said cold water holding tank which interrupts power in the event of tank overfill;

(bb) a vent-relief means incorporated in said cold water holding tank which permits the ingress and egress of air to and from said cold water holding tank (cc) a vent relief flow means coupled to the upstream side of each hot water outlet, which permits the ingress and egress of air, and permits water flow to the attached outlet;

(dd) a thermal switch means, coupled to said hot water holding vessel which, when the temperature in the vessel drops below a set point, will cause the actuation of a combination of, remotely actuated valve means and the pump means to enable said pump means to simultaneously circulate reduced temperature water in the holding vessel back to the water heater, and hot water to circulate from the water heater to said hot water holding vessel;

(ee) a thermal switch power relay, energized by said thermal switch means which actuates the associated remotely actuated valve means and the pump means;

(ff) a remotely actuated valve means and the associated conduit means in fluid communication with the vent relief split flow nipple coupled to said hot water holding vessel and inlet of said pump means, for circulating reduced temperature hot water out of said hot water holding vessel;

(gg) a remotely actuated valve means and the associated conduit means coupled to the vent relief split flow nipple coupled to the hot water heater and to the outlet of said pump means, for circulating reduced temperature hot water into said water heater;

(hh) a remotely actuated valve means and the associated conduit means in fluid communication with the vent relief split flow nipple coupled to the hot water heather and the inlet of the actuated pump means, for circulating desired temperature hot water out of said water heater;

(ii) a remotely actuated valve means and the associated conduit means coupled to the vent relief split flow nipple coupled to the hot water holding vessel and to the outlet of said pump means, for circulating desired temperature hot water into said hot water holding vessel.

6. A hot water recovery system, according to Claim 4, wherein a remotely actuated blending valve means and the conduit means, actuated and deactuated by remote command or by manual operation, being interposed between the cold water supply line and the hot water supply outlet of the flow control and recovery apparatus, to moderate the temperature of the hot water to the remote hot water outlets;

a control valve means for regulating the amount of cold water supplied to the input of said blending valve means.

7. The system according to claim 4 wherein the actuating power may be electrical, pneumatic, hydraulic or any combination of the above.

8. A hot water recovery system, according to claim 5, wherein a remotely actuated blending valve means and the conduit means, actuated and deactuated by remote command or by manual operation, being interposed between the cold water supply line and the hot water supply outlet of the flow control and recovery apparatus, to moderate the temperature of the hot water to the remote hot water outlets;

a control valve means for regulating the amount of cold water supplied to the input of said blending valve means.

9. The system according to claim 5 wherein the actuating power may be electrical, pneumatic, hydraulic or any combination of the above.

10. The system according to claim 5 wherein a plurality of tank means and outlet means is in fluid communication with the flow control and recovery apparatus;

a flow control and recovery apparatus, inclusive of one or more pump means, for controlling fluid flow and direction;

one or more fluid supply sources, in fluid communication with said flow control and recovery apparatus for the purpose of transferring, mixing, blending, filling or emptying said tank means and or said fluid supply sources;

a plurality of remotely actuated valve means and the conduits means in fluid communication with said tank means, with said outlets means and with said fluid supplies;

a plurality of pump means, in fluid communication with said fluid supply sources, said tank means, said outlet means and said flow control and recovery apparatus.

* * * * *